United States Patent [19]

Da Costa

[11] Patent Number: 5,004,408

[45] Date of Patent: Apr. 2, 1991

[54] DISCHARGE SYSTEM FOR ROTARY ROLLING PISTON COMPRESSOR

[75] Inventor: Caio M. F. N. Da Costa, Joinville, Brazil

[73] Assignee: Empresa Brasileira De Compressores S/A Embraco, Joinville, Brazil

[21] Appl. No.: 417,786

[22] Filed: Oct. 4, 1989

[30] Foreign Application Priority Data

Oct. 4, 1988 [BR] Brazil ..... PI8805216

[51] Int. Cl.[5] ..... F04C 29/08

[52] U.S. Cl. ..... 418/15; 418/63

[58] Field of Search ..... 418/15, 63, 270

[56] References Cited

U.S. PATENT DOCUMENTS 1,931,017 10/1933 Buchanan et al. ..... 418/63
2,763,472 9/1956 Fontaine ..... 418/63 X
4,730,996 3/1988 Akatsuchi et al. ..... 418/63 X

FOREIGN PATENT DOCUMENTS 21610 2/1979 Japan ..... 418/15

*Primary Examiner*—Michael Koczo
*Attorney, Agent, or Firm*—Darby & Darby

[57] ABSTRACT

Discharge system for rotary rolling piston compressor of the type that comprises a cylinder housing a rolling annular piston and a sliding vane which defines a suction and discharge volumes in the space between the piston and the cylinder and the inner faces of main and sub bearing plates, one of the plates having a discharge valve in communication with the discharge volume and being provided with a suction orifice. A gas outlet means communicates with the interior of the cylinder and has at least two gas intake positions one arranged in the extreme final region of the discharge volume and the other arranged radially set back and angularly advanced relative to the first.

8 Claims, 3 Drawing Sheets

○ORIFICE OPEN
●ORIFICE CLOSED

DISCHARGE SYSTEM FOR ROTARY ROLLING PISTON COMPRESSOR

BACKGROUND OF THE INVENTION

The present invention relates to a rotary rolling piston compressor, and more specifically to a new implementation for the discharge system of this type of compressor.

The dimensioning of the discharge system components of a rotary rolling piston compressor, which are the discharge orifice, the discharge valve, the valve reinforcement and the bumper is crucial to the compressor's satisfactory performance.

Among the variables that influence this dimensioning is the discharge orifice diameter. A large diameter has the advantage of more rapidly discharging the gas compressed in the interior of the cylinder, therefore, reducing the loss by over compression, related to the readiness of the cylinder emptying at every discharge cycle. However, a discharge orifice of a large diameter increases the compressor dead volume. This impairs the compressor volumetric efficiency by the gas backflow at high pressure to the suction volume and it may reduce the suction fill up operation. Also the energy efficiency is decreased, also by the gas that flows from the dead volume back to the suction volume since this increases the compression work at every new cycle.

Another disadvantage of using a large diameter at the discharge orifice is due to the geometrical fact that the larger is the orifice the earlier the compressor compression cycle will finish, i.e., at a rotation angle some degrees earlier. This reduces the compression cycle and at the same time it also increases another dead volume which is formed between the cylinder and the rolling piston walls and the vane wall at the end of the compression, giving rise to the same disadvantages already said to be the case of the dead volume created in the discharge orifice. Besides that, a larger discharge orifice diameter increases the compressor noise level. This is described in the technical literature on the subject.

One method commonly used to reduce the above mentioned problems, especially in large capacity compressors, is the utilization of two discharge orifices and respective valves, each one placed at each end of the cover of the compressor set. This solution has the disadvantages of needing the placement of two discharge valves with all their assembly procedures and the machining of two valve seats, as well as requiring the provision of two muffler chambers. Furthermore, an increase of the compressor noise level is almost certain to happen.

Another known solution uses a discharge system with cylindrical valve (see Brazilian patent PI 860 3449). In this solution, the discharge area is enlarged with the placement of several holes lying across the cylinder internal wall. Although this solution is effective in relation to the efficiency of the gas discharge, obviously it is difficult to execute due to the transverse machining of the holes.

BRIEF DESCRIPTION OF THE INVENTION

The object of the present invention is to provide a discharge system for a rotary rolling piston compressor which is able to eliminate the deficiencies mentioned above of the presently known systems.

The discharge system of the present invention is used in a rotary rolling piston compressor of the type that includes a cylinder housing a rolling annular piston and a sliding vane. The vane defines the discharge and suction volumes, or chambers, in the space between the piston and the cylinder. The discharge and suction chambers are also defined by the surfaces of main and sub bearings, one being on each side of the cylinder. The bearing or sub bearing is provided with a discharge valve in communication with the cylinder discharge volume through a gas outlet mean. A bearing or sub bearing is provided with a suction orifice. The opening and the closing of both the gas outlet means and the suction orifice is caused by the angular position of the adjacent annular face of the rolling piston.

According to the invention, the gas outlet means communicates with the interior of the cylinder discharge volume and has at least two spaced apart gas intake or inlet positions. The inlet positions have an angular alignment relative to the discharge volume.

In a preferred embodiment, there are two inlets for the gas discharge means. The second inlet position is arranged adjacent to the sliding vane and to the external cylindrical surface of the discharge volume. The first inlet position is arranged radially set back relative to the second and angularly advanced in relation to it, considering the direction of piston rotation. The alignment, the separation and the dimensioning of the said gas intake positions are made so that the closing of the second position begins upon the end of the closing of the first position; the reopening of the first position begins only after the beginning of the reopening of the second position; and the reopening of the first position is completed only upon the end of the reopening of the second position.

In one embodiment of the invention the gas outlet means is provided in the form of a single orifice arranged through one of the bearing plates. One end of the single orifice, which is turned to the discharge volume of the cylinder, defines the gas discharge orifice second inlet position and the first gas discharge orifice inlet position is defined by an end of a recess made on the internal face of the respective bearing plate, according to the said angular alignment to the compressed discharge volume. The other end at the orifice communicates with the extremity of the gas discharge orifice which defines the first gas intake position.

The discharge system operates in the following manner: While the rolling piston is completing its compression cycle, the discharge begins (at about 240°). At this point, both inlets of the gas discharge orifices are open. As the piston continues rotation, its annular face closes the first orifice inlet until the end of the cycle and the completed discharge. With this arrangement, a considerable improvement on the discharge system operation is achieved.

The first inlet position of the gas discharge orifice will only act in the initial part of the discharge when a greater volume of gas needs to be discharged. Gradually, the rolling piston annular face will be closing the inlet thus making possible a smooth discharge.

Another important fact is that the first inlet of the gas discharge orifice is placed slightly away from the cylinder wall. This makes possible the delay of its reopening. Therefore, the dead volume backflow contained in the first inlet position only occurs at the time that the second inlet position is also reopening, after the rolling piston passage. The expression "reopening" means to reestablish the fluid communication among the dead volume of gas contained in the gas outlet mean and the cylinder suction chamber. This occurs after the passage of the annular face of the rolling piston over the internal extremity of the gas outlet means. While the annular face of the rolling piston is passing through the positions of the inlets to the gas discharge orifices, the fluid communication (or backflow) will be cut. After the passage of the rolling piston the fluid communication is reestablished.

This delay on the reopening makes possible a better filling of the suction volume, without problems of gas backflow by the suction orifice. Therefore, care should be taken so that the shock wave caused by the release of dead volume of gas compressed in the gas outlet means does not have enough time to achieve the suction hole before its closing, that is why their reopening are delayed at maximum.

Also, the fact of the rolling piston itself closing the first inlet position of the gas discharge means makes possible that all gas inlet positions are actuated by the same valve without problems of gas backflow already discharged in the shell back to the cylinder.

Another benefit of this solution is that it keeps away the problems of increase of noise level resultant of the use of a diameter of a too large orifice in order to improve the readiness of the discharge of the cylinder.

As constructive benefits, the invention uses the same valve stop, fastening, seat and single muffler chamber to both discharge orifices and also, the simplicity of the required machining, can be mentioned.

BRIEF DESCRIPTION OF THE DRAWINGS

The invention will be described as following by making reference to the accompanying drawings, wherein.

DETAILED DESCRIPTION OF THE INVENTION

Figure 1:
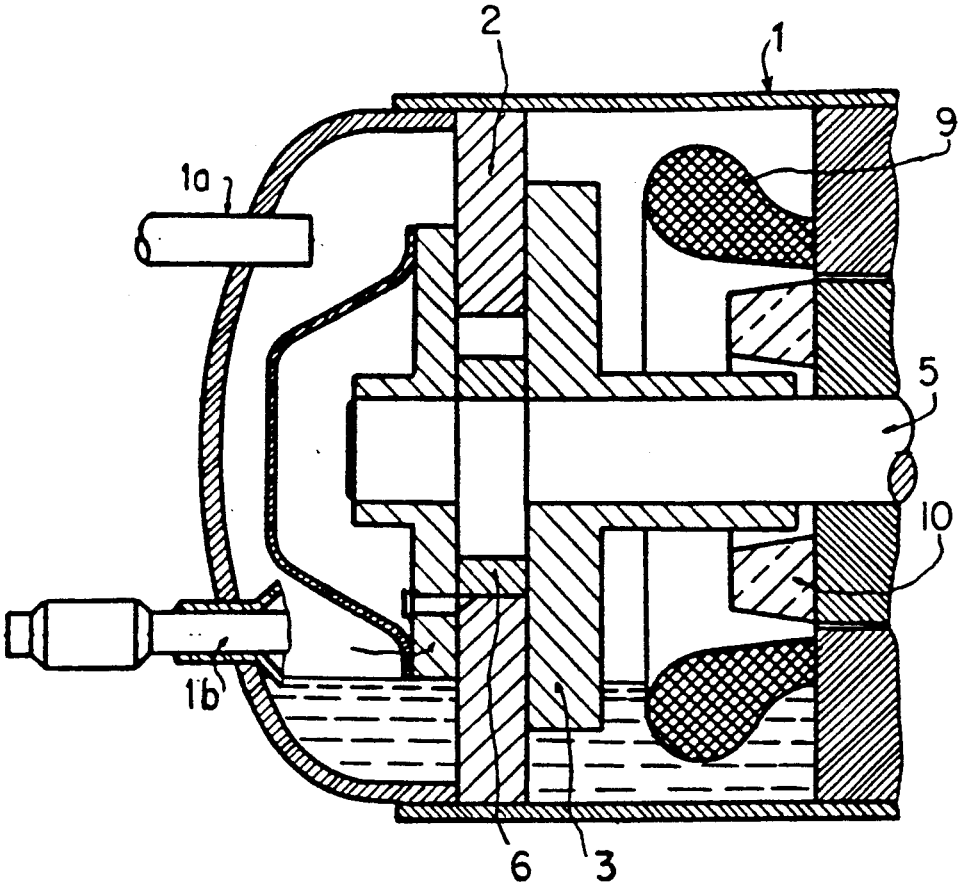
FIG. 1 is a partial longitudinal sectional view of a rotary rolling piston compressor of the type used in the present invention.

Referring to FIG. 1 the compressor under discussion includes a shell 1 to which suction 1*a* and discharge 1*b* tubes are fixedly mounted and in whose interior a compressor set and an electric motor are conventionally mounted.

The compressor set includes a cylinder 2, a main bearing 3 and a sub bearing 4. The main bearing 3 and sub bearing 4 plates are fixedly mounted to opposite walls of the cylinder 2, serving as the bearings for a crankshaft 5 of an electric motor which drives an eccentrically mounted rolling piston 6 in the interior of the cylinder 2. The electric motor has a coiled stator 9 and a rotor 10 to which the crankshaft 5 is mounted.

Figure 2:
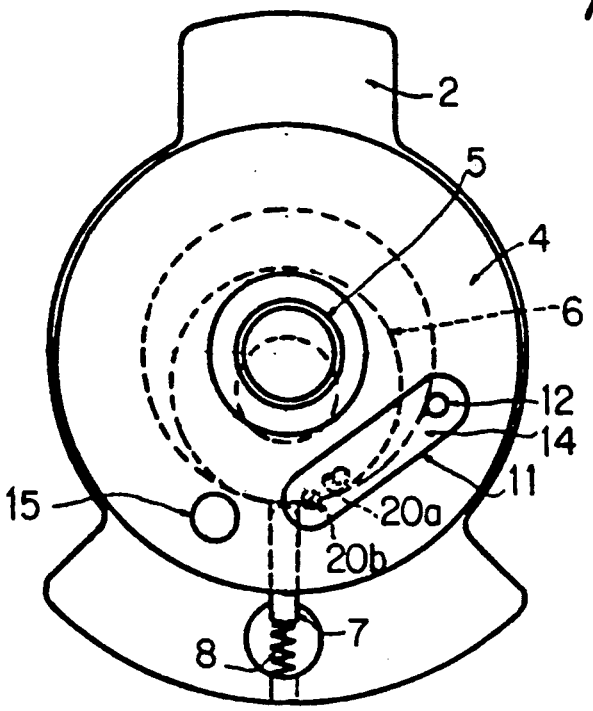
FIG. 2 is an axial end view of the sub bearing, cylinder, rolling piston and sliding vane set, being the sub bearing plate provided with the discharge valve which is a feature of the present invention.
Figure 3:
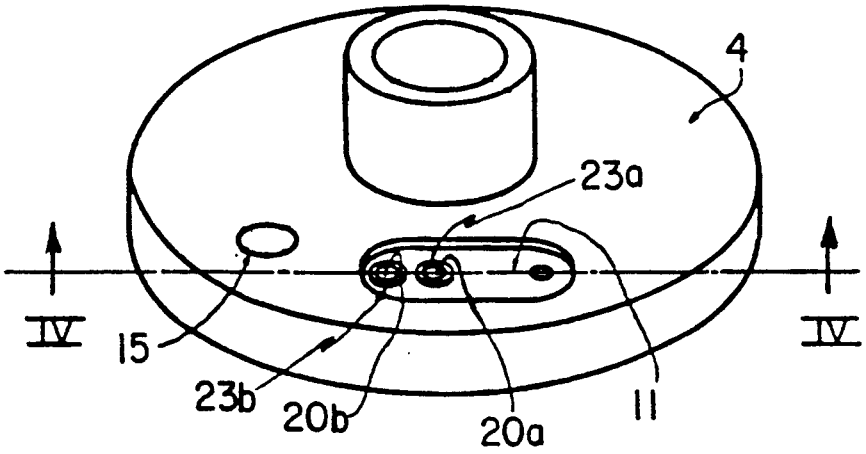
FIG. 3 is a perspective view of the sub bearing of FIG. 2.
Figure 5A:
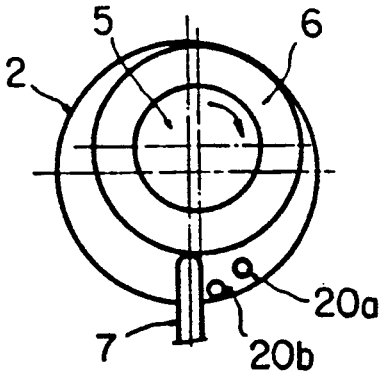
FIGS. 5*a* and 5*e* represent schematic extreme views of the set of cylinder, rolling piston, sliding vane and gas outlet of the sub bearing, illustrating the different angular positions of the rolling piston regarding the gas outlet.
Figure 5B:
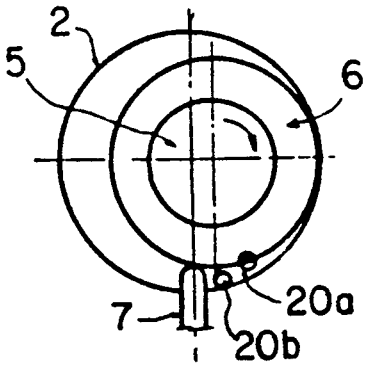
FIG. 5*f* is a view similar to FIG. 5*b* illustrating another configuration for the gas outlet.
Figure 5C:
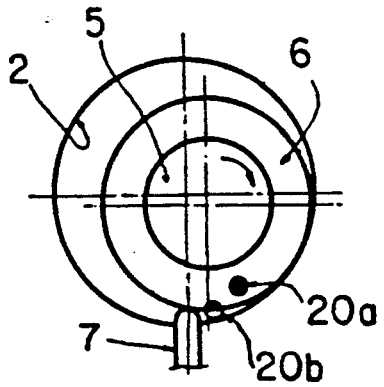
Figure 5D:
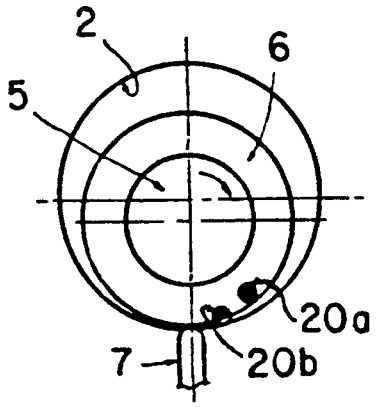
Figure 5E:
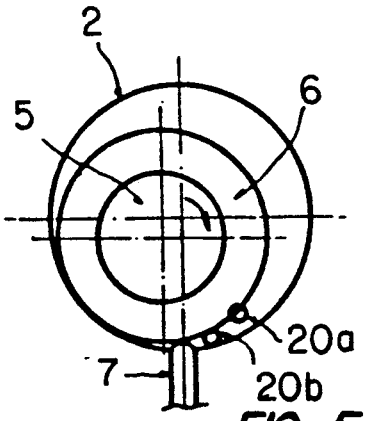

The compressor set also has a vane 7 (illustrated in FIGS. 2, 5*a* and 5*f*) axially biased by a spring 8 (FIG. 2) to slide in the interior of a radial slot of the wall of cylinder 2 with one end riding against the surface of the rolling piston 6. The sliding vane 7 defines on one side or face with the cylinder and the volume between the faces of the bearing and sub bearing a suction chamber. On the other side of the vane a discharge volume is formed.

As illustrated in FIGS. 2, 3, 4*a* and 4*b*, the sub bearing 4 has an elongated recess 11 formed on its exterior face. A suction orifice 15 is also formed through the sub-bearing. In the elongated recess 11 there is located a laminar spring leaf type discharge valve 13 and a stop 14, the end of each being mounted to the sub bearing by a rivet 12.

The recess in the sub bearing plate 4 forms the gas outlet means from the interior of the cylinder 2 and, more specifically, from the discharge volume defined between the rolling piston 6 and the cylinder 2.

In the configuration illustrated in FIGS. 3, 4*a*, 4*b*, 5*a* and 5*e* the gas outlet includes two discharge orifices 20*a* and 20*b* separated from each other and located near one end of the elongated recess 11. The orifices 20*a* and 20*b* define two distinct gas inlet positions for gas discharge arranged on the part of the internal face of the sub bearing 4 which communicates with the cylinder 2 discharge volume.

Figure 4A:
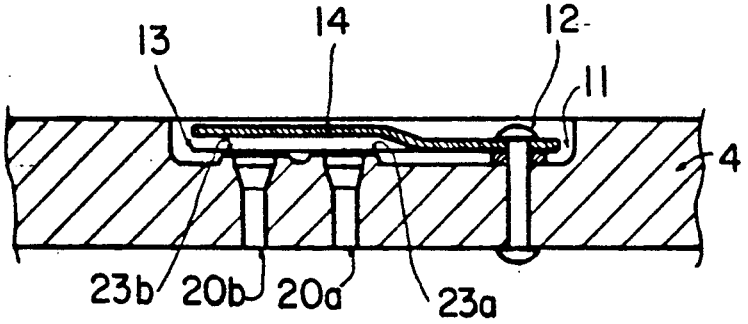
FIG. 4*a* is an enlarged sectional view of the sub bearing along lines IV—IV of FIG. 3.
Figure 4B:
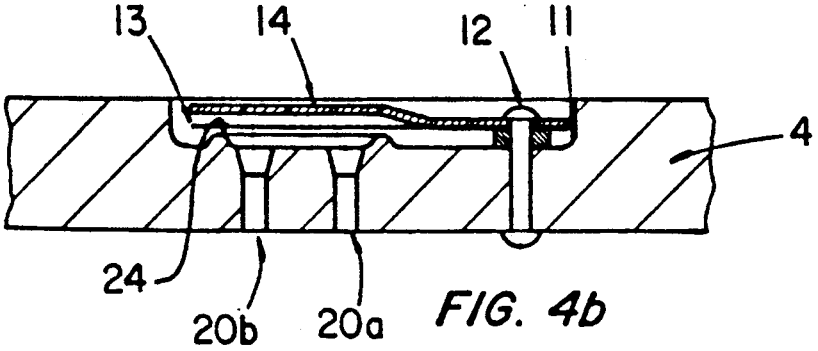
FIG. 4*b* is an enlarged sectional view similar to the one of FIG. 4*a* showing another configuration for the discharge valve orifice.

As shown in FIG. 4*a* the ends of the orifices 20*a* and 20*b* on the extended face of the sub bearing have respective distinct surrounding seats 23*a* and 23*b* for the valve 13. In FIG. 4*b* these orifices 20*a* and 20*b* are surrounded by a single seat 24. The orifices 20*a*, 20*b* are normally closed by the spring loaded valve 13 which rests on the seats 23*a*, 23*b*. In operation, the valve 13 is opened by the internal pressure in the cylinder discharge chamber. As the piston 6 rotates past an opening 20*a* or 20*b* it closes that opening and prevents gas from entering to open the valve 13.

As best seen in FIGS. 5*a* to 5*e*, the inlet of the second discharge orifice 20*b* is located adjacent to the external cylindrical face of the discharge volume and closer to the vane 7. The suction volume chamber is on the other side of the vane. The inlet of the second orifice 20*b* position is in the extreme final region of the cylinder discharge volume, i.e., in the place commonly used to the placement of the discharge orifice of any rotary rolling piston compressor.

The first discharge orifice 20*a* inlet is located at a point angularly advanced relative to the rotation of the piston 6 and radially set back relative to the second discharge orifice 20*b*. The radial set back and the angular advance of the first orifice 20*a* in relation to the second one 20*b* is selected so that the reopening of the first orifice 20*a*, after the passage of the piston 6, only takes place after the reopening of the second discharge orifice 20*b* (see FIG. 5*e*).

With this arrangement, both discharge orifices 20*a* and 20*b* are arranged on an angular alignment to the cylinder discharge volume with the dimensioning of the diameter of the orifices 20*a* and 20*b* realized in a way to allow a smooth and efficient discharge of the compressed gas in the discharge volume, with a minimum of dead volume.

The discharge valve arrangement also causes the closing of the second discharge orifice 20*b* to start only upon the end of the closing of the first discharge orifice 20*a* (see FIG. 5*c*) by the action of the annular of the rolling piston 6, thereby allowing a progressive and smooth discharge of the compressed gas. The duct area of the gas outlet is then progressively reduced from a maximum value, corresponding to the beginning of the discharge when there is a greater volume of compressed gas in the cylinder, to a null value or of discharge closing, as while the volume of compressed gas to be discharged is getting reduced.

The discharge orifices 20*a* and 20*b* are positioned so that the reopening of the first orifice 20*a* only gets completed upon the end of the reopening of the second orifice 20*b* (See FIG. 5*e*) meaning that the dead volume release of the first orifice 20*a* only takes place after the closing of the suction orifice 15 by the rolling piston 6, it being understood that the second orifice 20*b* is conventionally projected to reopen only after the closing of the suction orifices.

Figure 5F:
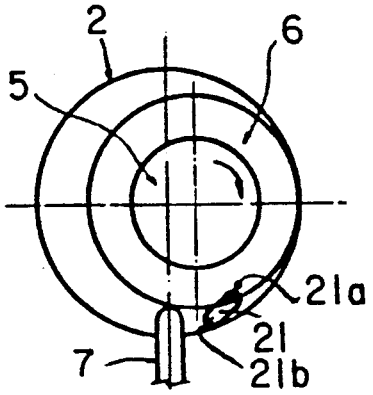

FIG. 5*f* illustrates a variation of the gas outlet mean that is defined by a single discharge opening 21 with the shape of an elongated slot having one end placed at the extreme final region of the cylinder 2 discharge volume. This slot communicates with the elongated recess 11 of the external face of the sub bearing plate 4, under the discharge valve 13.

As seen, the discharge opening 21 is arranged according to the same alignment applied to the orifices 20*a* and 20*b* of the first embodiment, in a way to maintain the first end 21*a* in a position radially set back and angularly advanced relative to the other end 21*b* of the discharge opening 21.

Regarding the first embodiment it is also possible to provide more than two gas discharge orifices according to the same angular alignment to the cylinder 2 arranged in the described way with relation to both discharge orifices of FIGS. 3, 4, 4*a* and 5*e*.

It is also possible to have an association of the two embodiments, in a way to have, for example, two or more orifices with the internal extreme of that more angularly advanced connected to an elongated internal recess of the bearing plate in which the discharge valve is placed, this internal recess being responsible for the definition of the first position of gas intake.

While only two configurations for the discharge system have been shown, it should be understood that alterations can be done without digressing from the inventive conception defined in the claims.

What is claimed is:

1. A rotary rolling piston compressor with improved discharge system comprising:

a housing, an annular cylinder mounted within said housing;

a bearing and a sub bearing on opposite faces of said cylinder;

a rolling piston eccentrically mounted on a crankshaft rotating within said bearing and sub bearing for rotation within said cylinder;

means within the cylinder defining a discharge chamber and a compression chamber, discharge valve means on one of said bearing and sub bearings having a discharge outlet in communication with the volume of the cylinder discharge chamber, said discharge outlet having spaced first and second inlets with the second inlet being closer to the chamber defining means and the first inlet located radially inward of the second inlet and angularly displaced relative to the second inlet toward the direction of piston rotation, the separation and the dimensioning of said first and second gas inlets being such relative to the piston and to each other that the closing of the second inlet by the piston starts upon the end of the closing of the first inlet, the reopening of the first inlet only starts after the reopening of the second inlet and the reopening of the first inlet is completed only after the end of the reopening of the second inlet.

2. A compressor, according to claim 1, wherein the gas discharge outlet comprises at least two gas discharge orifices arranged through the bearing or sub bearing respectively defining the positions of said first and second inlets, and a valve responsive to the pressure in the discharge chamber for opening and closing the outlets of said discharge orifices.

3. A compressor according to claim 2, wherein each one of the gas discharge orifices has its outlet end adjacent to the valve and with a separate valve seat surrounding each orifice discharge end.

4. A compressor according to claim 2 wherein the gas discharge orifices have their outlet ends adjacent to the valve and have a common valve seat.

5. A compressor according to claim 1, wherein the gas outlet mean comprises a single discharge opening in the shape of an elongated slot in the bearing or sub bearing, the ends of the elongated slot respectively defining the first and second inlets.

6. A compressor according to claim 2 wherein said valve comprises a resilient member which is biased to normally close the outlet ends of said gas discharge orifices and is opened in response to a predetermined pressure in the discharge chamber.

7. A compressor according to claim 3 wherein said valve comprises a member which is biased to normally rest on the valve seats to close the outlet ends of said gas discharge orifices and is opened in response to a predetermined pressure in the discharge chamber.

8. A compressor according to claim 4 wherein said valve comprises a member which is biased to normally rest on the valve seat to close said the outlet ends of said gas discharge orifices and is opened in response to a predetermined pressure in the discharge chamber.

* * * * *